US005507161A

United States Patent [19]

Broekaert et al.

[11] Patent Number: 5,507,161

[45] Date of Patent: Apr. 16, 1996

[54] DEVICE FOR LOCKING A CLOSURE MECHANISM FOR LUGGAGE

[75] Inventors: Dirk Broekaert, Heernstraat; Willy Van Hoye, Wittebroodhof; Erik Wijnen, Brassachaat, all of Belgium

[73] Assignee: Samsonite Corporation, Denver, Colo.

[21] Appl. No.: 169,908

[22] Filed: Dec. 20, 1993

[30] Foreign Application Priority Data

Dec. 22, 1992 [FR] France ..... 92 15514

[51] Int. Cl.[6] ..... E05B 49/02; E05B 65/52

[52] U.S. Cl. ..... 70/71; 70/69; 70/277; 70/278; 70/283; 292/201

[58] Field of Search ..... 70/278, 69, 71, 70/277, 278, 279, 281, 283; 292/33, 201, 144, 335

[56] References Cited

U.S. PATENT DOCUMENTS

| | | | |
|---|---|---|---|
| 3,555,860 | 1/1971 | Atkinson | 70/71 X |
| 4,148,092 | 4/1979 | Martin | 70/278 X |
| 4,426,862 | 1/1984 | Yamada et al. | 70/278 X |
| 4,522,047 | 6/1985 | Johl | 70/278 X |
| 4,671,087 | 6/1987 | Olenfalk et al. | 292/336.3 X |
| 4,885,922 | 12/1989 | Lutz | 292/201 X |
| 4,917,022 | 4/1990 | Ogasawara et al. | 70/278 X |
| 4,972,182 | 11/1990 | Novik et al. | 70/278 X |
| 5,033,282 | 7/1991 | Gartner et al. | 70/278 |
| 5,164,718 | 11/1992 | Cedergren | 70/278 X |

FOREIGN PATENT DOCUMENTS

| | | | |
|---|---|---|---|
| 1169948 | 6/1984 | Canada | 70/278 |
| 2111580 | 7/1983 | United Kingdom | 70/278 |

*Primary Examiner*—Lloyd A. Gall

*Attorney, Agent, or Firm*—Gregory W. O'Connor; Rod D. Baker

[57] ABSTRACT

The invention is a device for locking the closure mechanism on an item of luggage. The device includes a movable rod which drives a movable clasp bolt on one part of the luggage. The clasp bolt interacts with an opening in another part of the luggage, which opening serves as the strike for the clasp bolt. A movable latch may be interposed in the path of the rod, so that in an active position the latch blocks the movement of the rod, thus locking the case, but when the latch is in a retracted position the rod is released. The latch is moved by an electric motor connected to the latch by a gear reduction unit which amplifies the output torque of the motor. The latch may remain in its blocking position when motor torque is not supplied. A control signal generator actuates the motor in response to the reception of an access code input by the user.

11 Claims, 9 Drawing Sheets

FIG.4
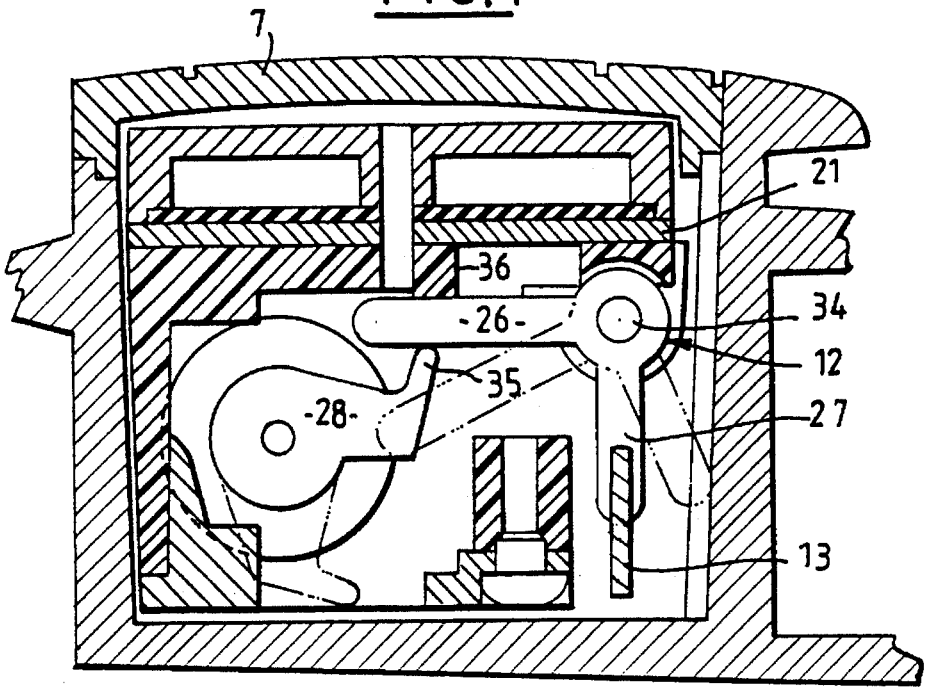
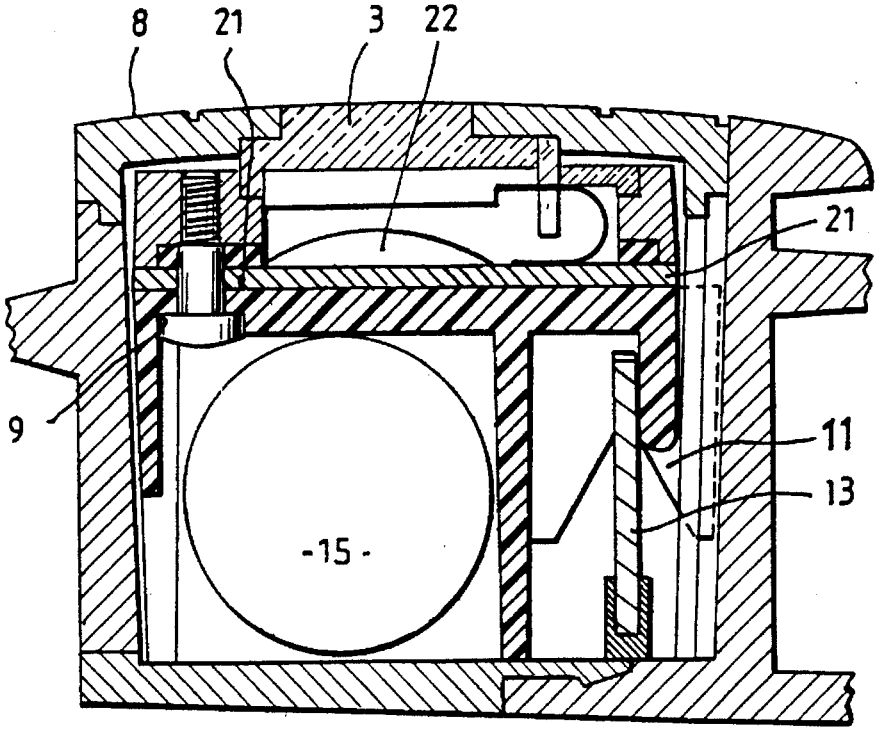
FIG.5

DEVICE FOR LOCKING A CLOSURE MECHANISM FOR LUGGAGE

BACKGROUND OF THE INVENTION

1. Field of the Invention

The present invention relates to closure mechanisms for luggage in general, and more particularly relates to a closure mechanism with locking by interposition of a latch on the path of a rod system for driving bolts, which can be moved in translation by operating buttons and which is arranged in a first part of an item of luggage and interacting with members forming the strikes carried by a second part of the luggage.

2. Description of the Background Art

Closure mechanisms for luggage are known which comprise, housed in a channel made in one edge of a part of an item of luggage such as a briefcase, a drive rod which extends from a point close to one branch of the handle of the briefcase as far as the proximity of one end of the part of the briefcase. A finger-operated drive member is fixed on to the outer end part of the drive rod. A compression spring interacts with the drive rod and with the walls of the channel in order to stress the drive rod axially towards the center of the wall of the corresponding part of the briefcase.

The end of the drive rod opposite the drive member is folded transversely to the direction of the translational movement of the drive rod along the channel. A bolt of the hook type is fixed to the drive rod and extends towards the other part of the briefcase to be received, when the two parts of the briefcase are brought together, in an opening of the other part of the briefcase forming a strike, and to engage with one edge of the opening.

The displacement of the drive rod against the action of the spring unhooks the bolt from the edge of its reception opening and allows the two parts of the briefcase to be separated.

Means for locking a mechanism, of the type described hereinabove, are also known which comprise a latch intended to be interposed on the path of displacement of each drive rod in order to prevent a translational displacement of the rod under the action of its corresponding drive member.

Such a latch is actuated by a lock of the key or combination type which either interposes the latch on the path of the or each drive rod with a view to locking the closure mechanism, or retracts the latch with a view to locking the said mechanism.

The invention aims to improve closure mechanisms of the aforementioned type.

SUMMARY OF THE INVENTION

The invention pertains to a device for locking a closure mechanism for luggage, comprising a latch intended to be interposed on the path of at least one rod for driving a clasp forming a bolt, movably mounted in a first part of the luggage, the clasp interacting with an opening forming a strike made in a second part of the luggage, and a mechanism for moving the latch between an active position of blocking the movements of the drive rod and a retracted position of releasing the drive rod, characterized in that the mechanism for moving the latch includes an electric motor connected to the latch by means of a gear reduction unit for amplifying the output torque of the electric motor and for blocking the latch in position when the electric motor is not supplied and means for generating control signals for the electric motor in response to the reception of an access code.

BRIEF DESCRIPTION OF THE DRAWINGS

The invention will be better understood with the aid of the following description, which is given solely by way of example and is made with reference to the attached drawings, in which:

FIG. 4 is a view in cross-section on a larger scale along the line 4—4 in FIG. 2;

FIG. 5 is a cross-section on a larger scale along the line 5—5 in FIG. 2;

DESCRIPTION OF THE PREFERRED EMBODIMENT

Figure 1:
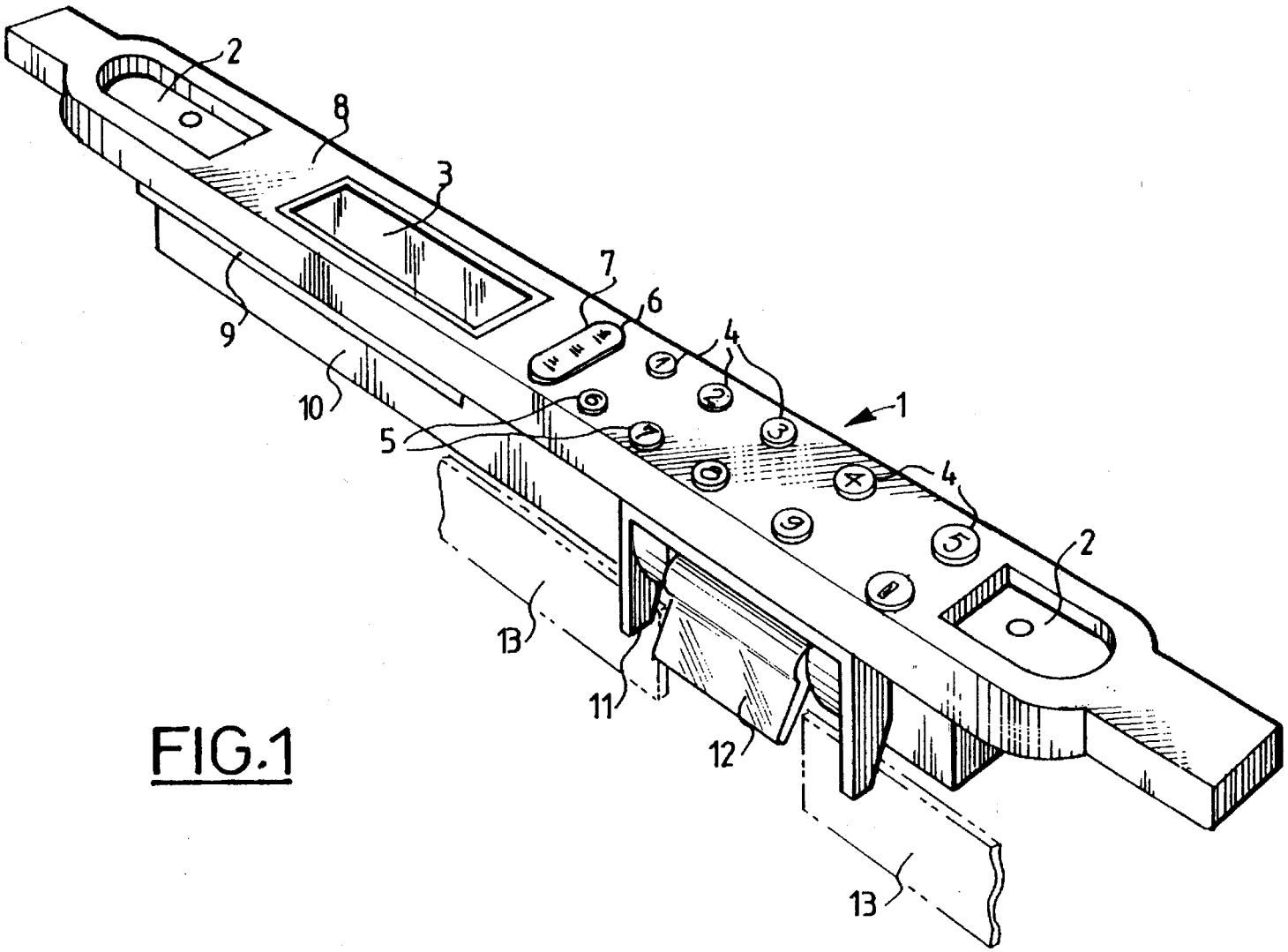
FIG. 1 is a diagrammatic perspective view of a luggage closure mechanism locking device according to the invention.

The closure mechanism locking device for luggage, which is represented in FIG. 1 principally includes a box 1 of elongate shape intended to be placed on the edge of a first side of a document briefcase for example and to receive a handle, not shown, in recesses 2 provided at the ends of its articulation bases.

On its outside face, the box 1 includes, starting from the left in FIG. 1, a display screen 3 of the liquid-crystal type, intended to allow display of different information and functions of the device.

There are also provided in the box, orifices 4 for receiving numerical actuation keys 5 including the numbers, 0 to 9 and an oblong orifice 6 through which another key 7 for actuating the device projects.

The keys 5 and 7 advantageously belong to a single rubber molded unit arranged in the box between the upper part and the lower part 9 of the latter and pressed against a printed circuit card which will be described below.

The lower part 9 of the box includes a battery compartment 10 formed integrally with the lower part, a yoke-shaped support 11 in which a latch 12 is tiltingly mounted, which latch is intended to be interposed between the ends of two rods 13 for driving bolts interacting with openings forming strikes made in the other side (not shown) of the briefcase.

The rods 13 have been represented in dot-dash lines in FIG. 1, but they are shown more clearly on the detail figures which will be described below.

A description will also be given below of the means for driving the latch 12 between its active position, interposed between the ends of the rods 13, and the retracted position of releasing these rods in translation.

Figure 2:
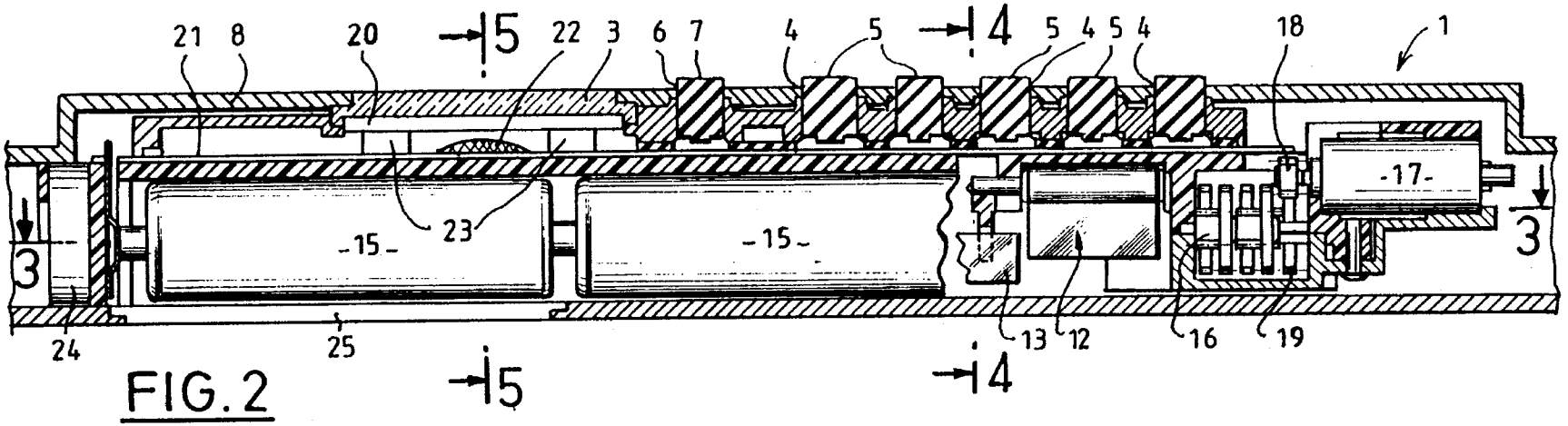
FIG. 2 is a view in longitudinal section, in side elevation, of the device according to the invention.

FIG. 2 is a view in longitudinal section of the locking device according to the invention.

It is seen in this figure that two batteries 15 are housed in the battery compartment 10.

The latch 12 intended to be interposed on the path of the rods such as 13 can be moved using a reduction gear 16 which is driven in turn by an electric motor 17 whose output gear 18 meshes with the first toothed wheel 19 of the reduction gear 16.

The transmission ratio of the reduction gear 16 is such that it amplifies the output torque of the electric motor 17 and allows the latch 12 to be blocked in position when the electric motor is not powered.

The display screen 3 includes a liquid-crystal unit 20 which is placed above an elongate printed circuit board 21 which carries an integrated circuit 22 with microprocessor and memory and areas for contact with the keys 5 and 7.

Between the liquid-crystal unit 20 and the printed circuit board 21 are arranged flexible rubber spacers 23. At the end of the box opposite the motor 17 is arranged a piezoelectric vibrator 24 connected to the terminals of the set of batteries 15. The battery compartment 10 is closed by a lid 25.

Figure 3:
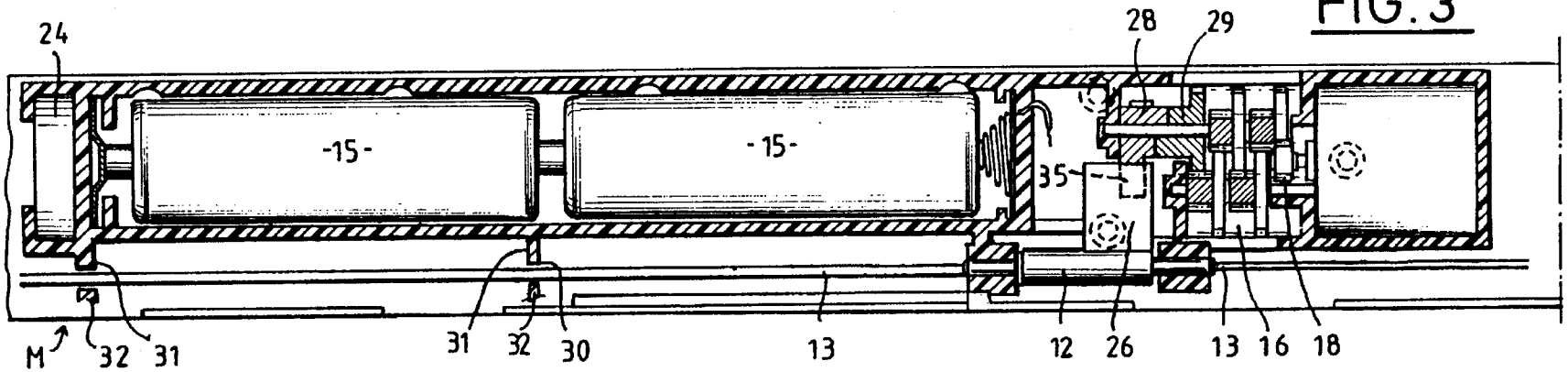
FIG. 3 is a view in section along the lines 3—3 in FIG. 2.

In FIG. 3 it is seen that the latch 12 includes a side branch 26 perpendicular to the plane of its branch 27 which can be moved on the path of the rods 13 and interacts with an actuation arm 28 driven by the output gear 29 of the reduction gear 16. The rods 13 are arranged on either side of the latch and can be moved in translation in the edge of the part of the briefcase M which receives the box of the locking device. They are guided in guides 30 consisting of gaps between fingers 31 integral with the lower part 9 of the box and corresponding projections 32 on the part of the briefcase receiving the locking device.

In FIG. 4, which is a view in cross-section of the locking device in the region of the latch 12, it is seen that this latch is mounted in rotation in the yoke-shaped support 11 by means of a spindle 34 and that the arm 28 for angular displacement or actuation of the latch 12 includes a bent portion 35 in contact with the branch 26 of the latch. In FIG. 4, the device according to the invention is shown in the locking position, in which the branch 26 of the latch 12 is held pressed by the arm 28 against a stop 36 provided in the box for receiving the device, so that the branch 27 of the latch 12, which is perpendicular to its branch 26 actuated by the arm 28, is interposed on the path of the rods 13 and therefore prevents them from being displaced in translation.

When the latch is released, it enters a position represented in dot-and-dash lines in FIG. 4, while the arm 28 for actuating this latch also assumes the position represented in dot-and-dash lines in this figure.

It is moreover seen in FIG. 5 that the rods 13 are guided in their displacement by the branches of the yoke-shaped support 11.

Figure 6:
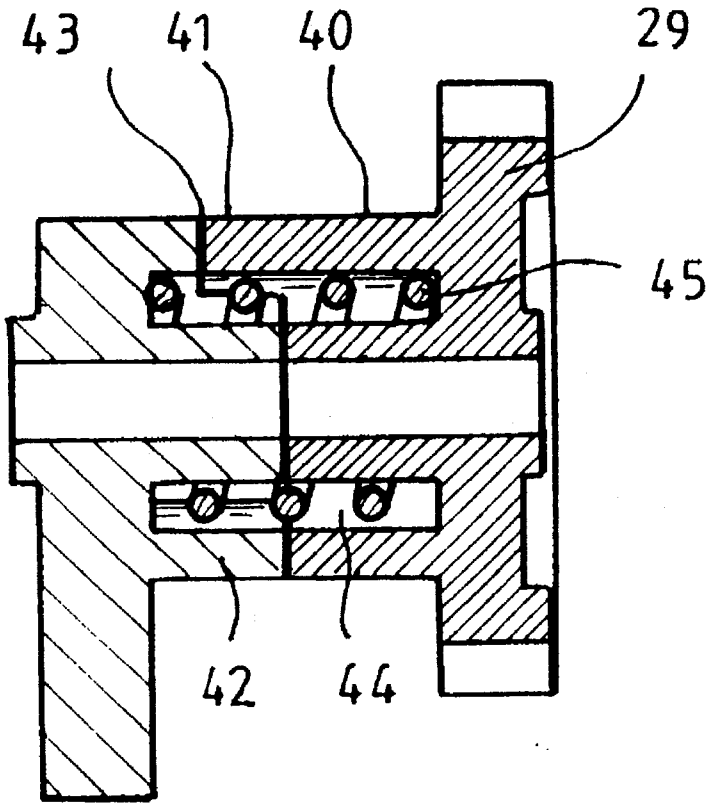
FIGS. 6 and 7 represent the means for linkage between the reduction gear associated with the electric motor for driving the latch and the latch of the locking device.

In FIG. 6, the means for linkage between the output gear 29 of the reduction motor 16 and the arm 28 for actuating the latch 12 are represented in section.

The output gear 29 includes a hub 40 provided with an axial extension 41, while the arm 28 also includes a hub 42 in which there is made a shoulder 43 extending over a large portion of the periphery of the hub 42, and against which the extension 41 of the hub 40 of the gear 29 bears.

Figure 7:
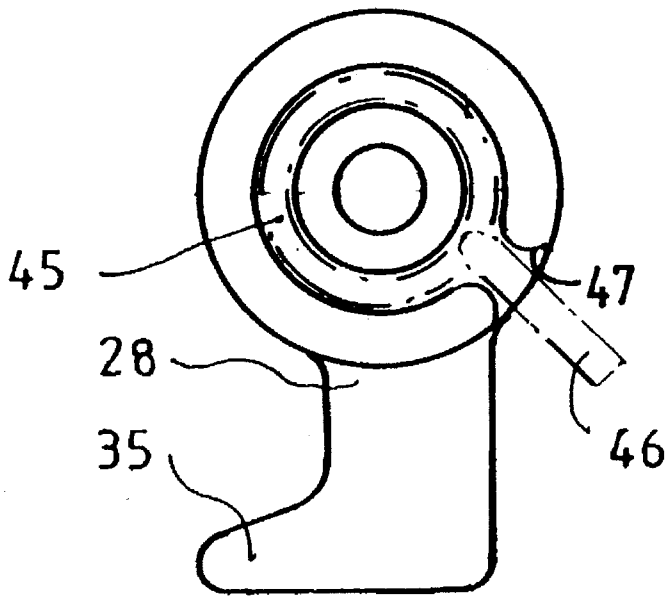

The assembled gear 29 and arm 28 together define an axial annular groove 44 in which is arranged a torsion spring 45 attached by its two ends respectively to the gear 29 and to the arm 28, as represented in FIG. 7, where one of the ends 46 of the spring is seen engaged in a radial passage 47 provided in the hub of the arm 28.

It is seen that, by virtue of such an arrangement, when the branch 26 of the latch 12, driven by the motor 17 via the reduction gear 16, comes into contact with the stop 36 (FIG. 4) and is therefore rotationally immobilized, the fact that the arm 28 is driven by the gear 29 of the reduction gear, via the spring 45, allows the output gear 29 to continue its rotational drive movement by compressing the spring 45 in order to hold the latch 12 elastically against the stop 36. During this movement, the extension 41 of the hub 40 of the gear 29 loses contact with the hub 42. In this way, the motor 17, and consequently the reduction gear 16, can, by rotating, tension the spring 45 while the arm 27 of the latch 12 is immobilized. The interposition of the spring 45 between the output gear 29 of the reduction gear and the arm 28 for actuating the latch 12 makes it possible to close the briefcase even when the latch 12 has been placed in the locking position with the briefcase open.

In fact, with the latch applied against the ends of the rods 13 by the spring 45, when the two parts of the briefcase are brought together with a view to closing it, the ends of the rods move away because of the engaging of their bolts in the corresponding strikes and free the passage for the latch under the action of its spring 45.

The displacement of the rods 13, caused by the engagement of the .bolts which they carry in the corresponding strikes, frees the passage for the latch which engages under the action of the return spring 45 in the gap left between the rods, thus locking the mechanism.

Figure 8:
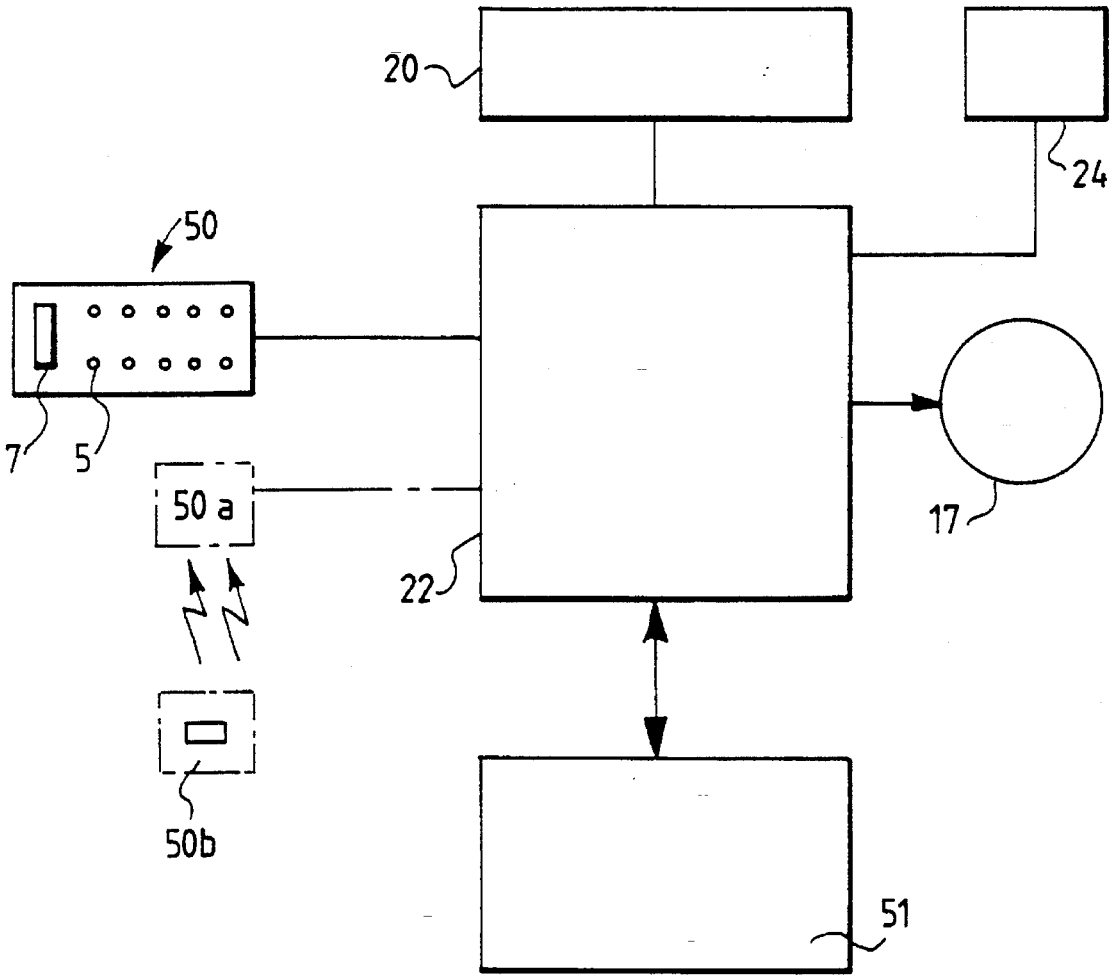
FIG. 8 is a block diagram of the electronic device for actuating the locking device according to the invention.

The block diagram in FIG. 8 represents the electronic device for actuating the locking device according to the invention. This device essentially includes the microprocessor 22 already represented in FIG. 2, with which is associated a keyboard 50 comprising the actuation keys 5 and 7 and the liquid-crystal display device as well as the buzzer 24.

According to one variant, the actuation device includes a remote-control signal receiver **50*a* connected to the microprocessor 22. An infrared or electromagnetic-wave remote-control transmitter 50*b*, containing in memory the code for access to the locking device, is associated with the receiver 50*a***.

Such an arrangement is optionally incorporated with the circuit in FIG. 8. This is why it is represented in dot-and-dash lines. In this way the device is actuated by the remote-control box **50*b* in parallel with the keyboard 50**.

The microprocessor 22 includes a memory 51 for storing information entered by means of the keyboard. It delivers electrical control signals to the electric motor 17 which, as described hereinabove, drives the latch 12 via the reduction gear 16 (FIG. 2).

One of the major drawbacks of conventional mechanical combination locks used on luggage resides in the fact that, when they are unlocked, anyone can read the numbers of the code from the dials or the corresponding display. In order to prevent this, the owner must always lock his briefcase or alternatively shift the numbers on its dial when the briefcase is left open.

The electronic lock according to the invention makes it possible to reveal the combination only for a few seconds during the manipulation of the lock, which improves the degree of security of the system. Most mechanical combination locks are limited to three dial wheels allowing $10^3$=1000 possible combinations, and all three wheels must be in the correct position for unlocking to be possible.

In the device according to the invention, the length of the combination code can be chosen between 1 and 4 digits.

The number of possible combinations in this case can be up to 11110:

$10^4$=10,000 four-digit codes $10^3$=1,000 three-digit codes $10^2$=100 two-digit codes $10^1$=10 single-digit codes.

The electronic lock is not in reality an anti-theft device, but it makes it possible to prevent unauthorized persons driven by curiosity from opening the briefcase.

In order to discourage someone from playing with the electronic lock or from attempting to ascertain the code of the combination, the system is designed to prevent, for a period of time, any attempted entry after three consecutive erroneous attempts.

A significant drawback to be overcome for locking devices of the electronic type which are intended for luggage is that of making it possible to avoid breakdowns when the batteries are exhausted.

For this purpose, the processor 22 has been programmed to monitor the voltage of the supply batteries 15 continually. If the voltage level of these batteries becomes too low, the locking device will be automatically unlocked and this event will be indicated on the display device 3. This solution is peculiar, given that in most security locks, it is preferred for the system to remain locked when the power falls off.

However, the applicants have chosen not to cause difficulty to the user when, after lengthy use, he has the problem of flat batteries, because it is not desirable to provide a backup system with a key.

In the system of the invention, the code of the electronic locking device can be chosen and reprogrammed freely by the user.

With conventional combination locks, the code of the user is often changed by accident, for example during a shop demonstration.

The electronic locking device according to the invention overcomes this drawback by requiring the real code to be entered before allowing the code-setting mode to be accessed. In addition, the processor requires confirmation of the new input code by demanding the new code to be entered a second time.

The user must thus be fully aware of what he is doing.

Another advantageous aspect of the program input into the microprocessor 22 of the locking device according to the invention is the procedure for recovering the forgotten code.

For most mechanical combination locks, there is a type of tool for servicing personnel intended to discover the setting of a code in the event of it being unknown or forgotten. A general code for opening all the locks or a fixed procedure for recovering the code from the microchip memory would probably be disseminated too easily, making the use of the coded lock pointless. For this reason, a procedure which is not overly simple has been provided for discovering the user code from the memory in a scrambled form. Only an authorized member of the personnel of the manufacturer has as the means for deciphering the code.

In addition to the function as a coded locking device, the locking device according to the invention has a certain number of characteristics programmed into the processor, such as the possibility of displaying the time and the date or the initials of the owner. These data are also protected by the same combination code which can be programmed by the user.

The operation of the electronic locking device according to the invention will now be described by way of example with reference to the flow charts in FIGS. 9 to 12.

Figure 9:
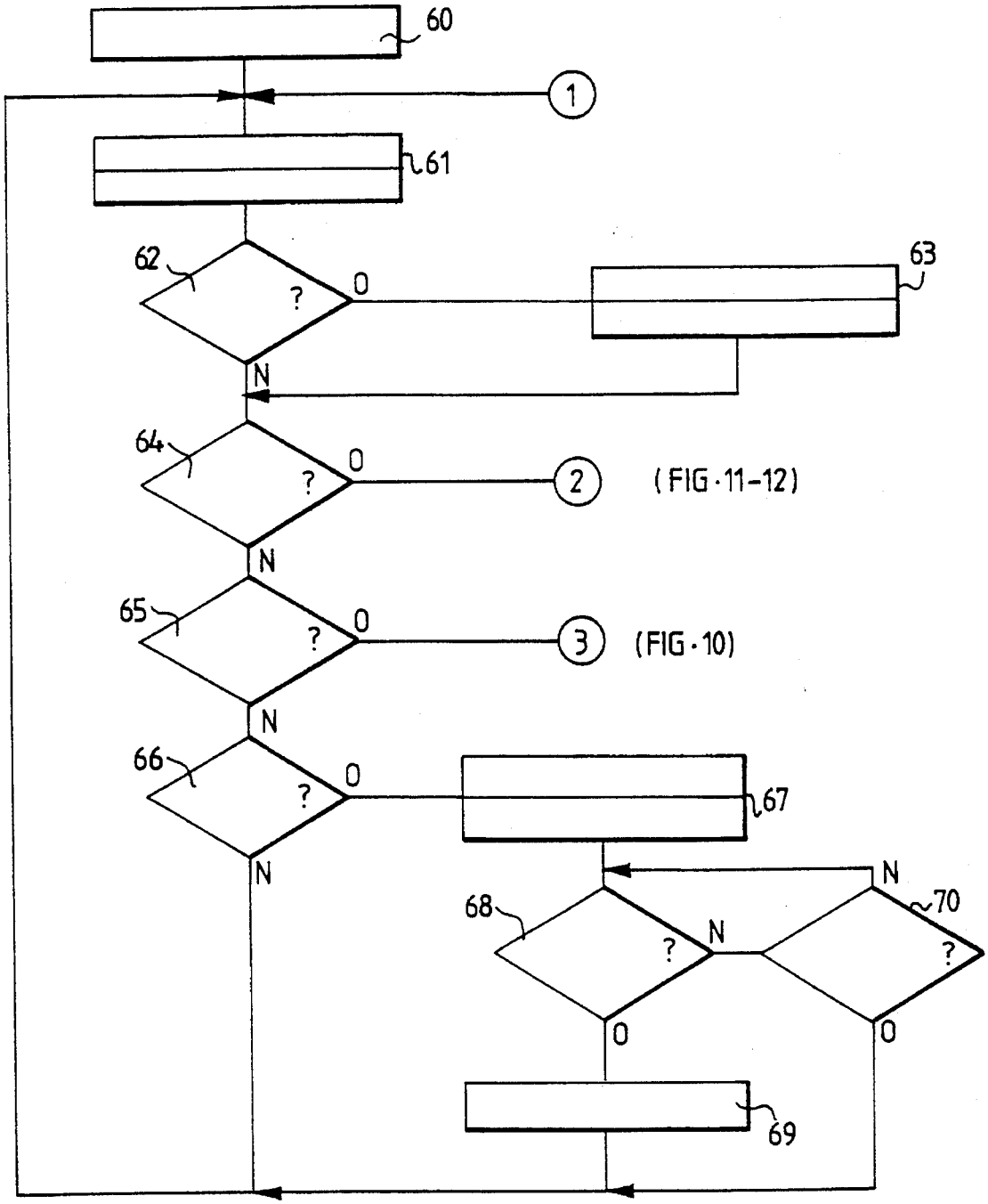
FIGS. 9 to 12 are flow charts showing the operation of the locking device according to the invention.

FIG. 9 represents the main loop of the flow chart.

During phase 60, the device is initialized. During phase 61, it is seen whether the display through the window 3 is normal, or whether it is re-established.

Following this operation, the question is asked during phase 62 whether or not there is an alarm. If so, the alarm function and its switching is executed during phase 63.

Figure 10:
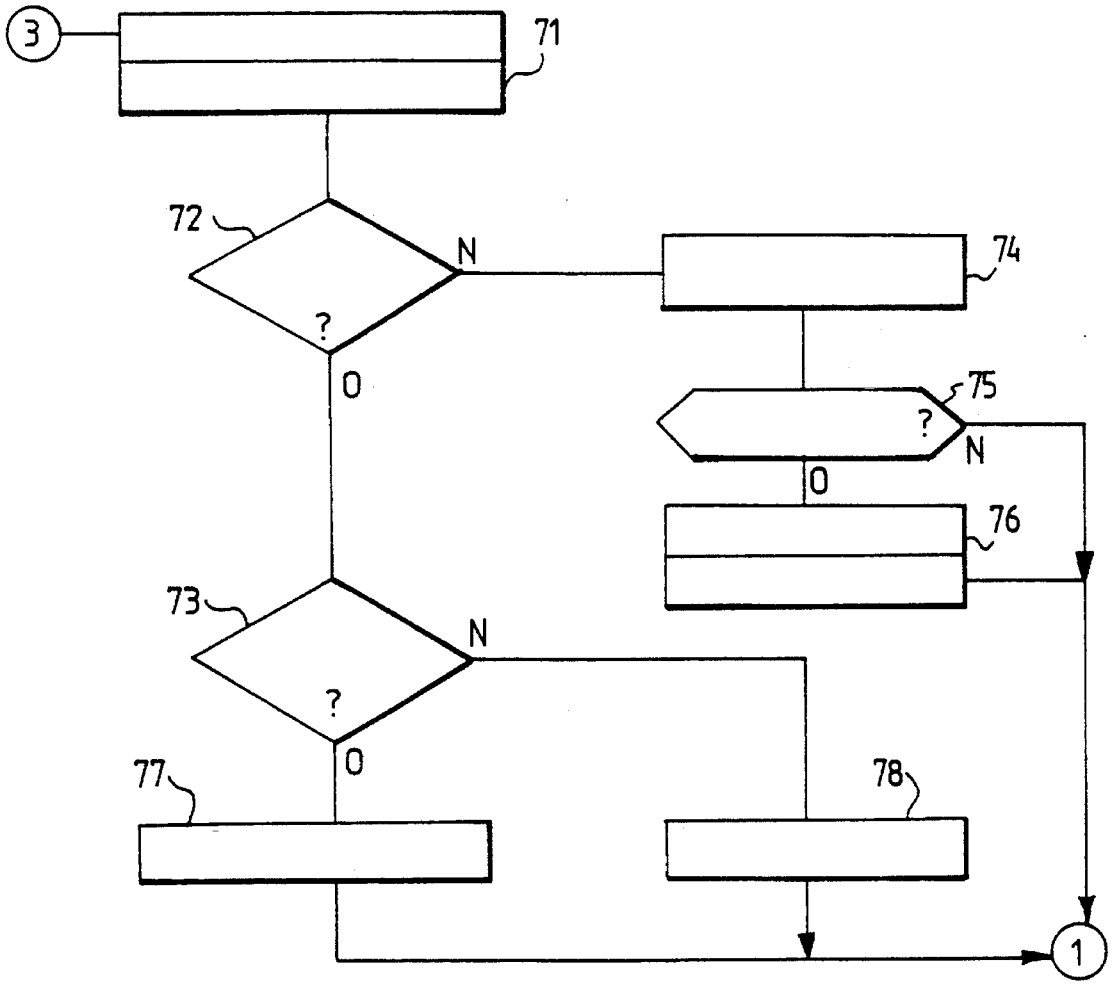
Figure 11:
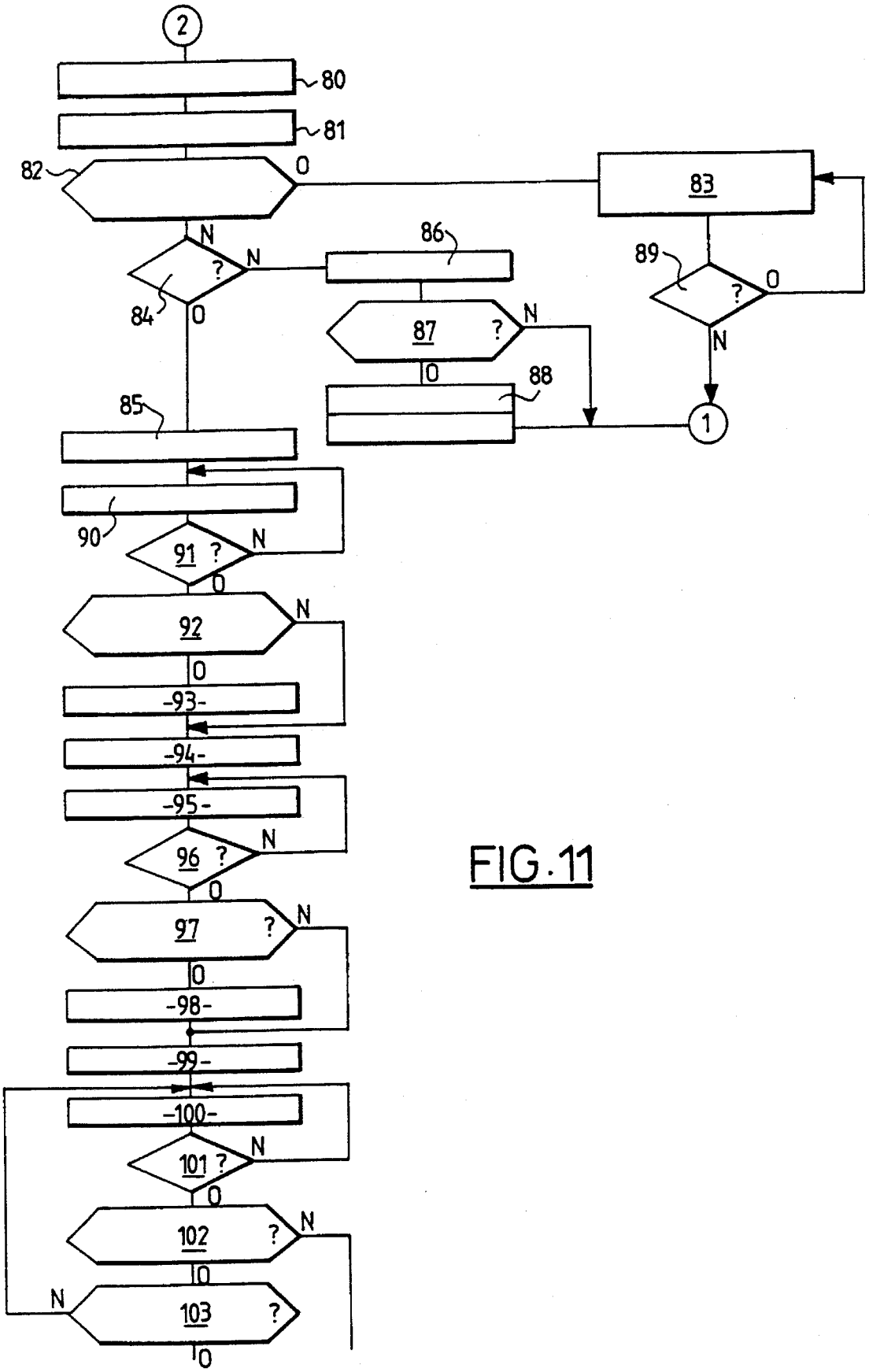
Figure 12:
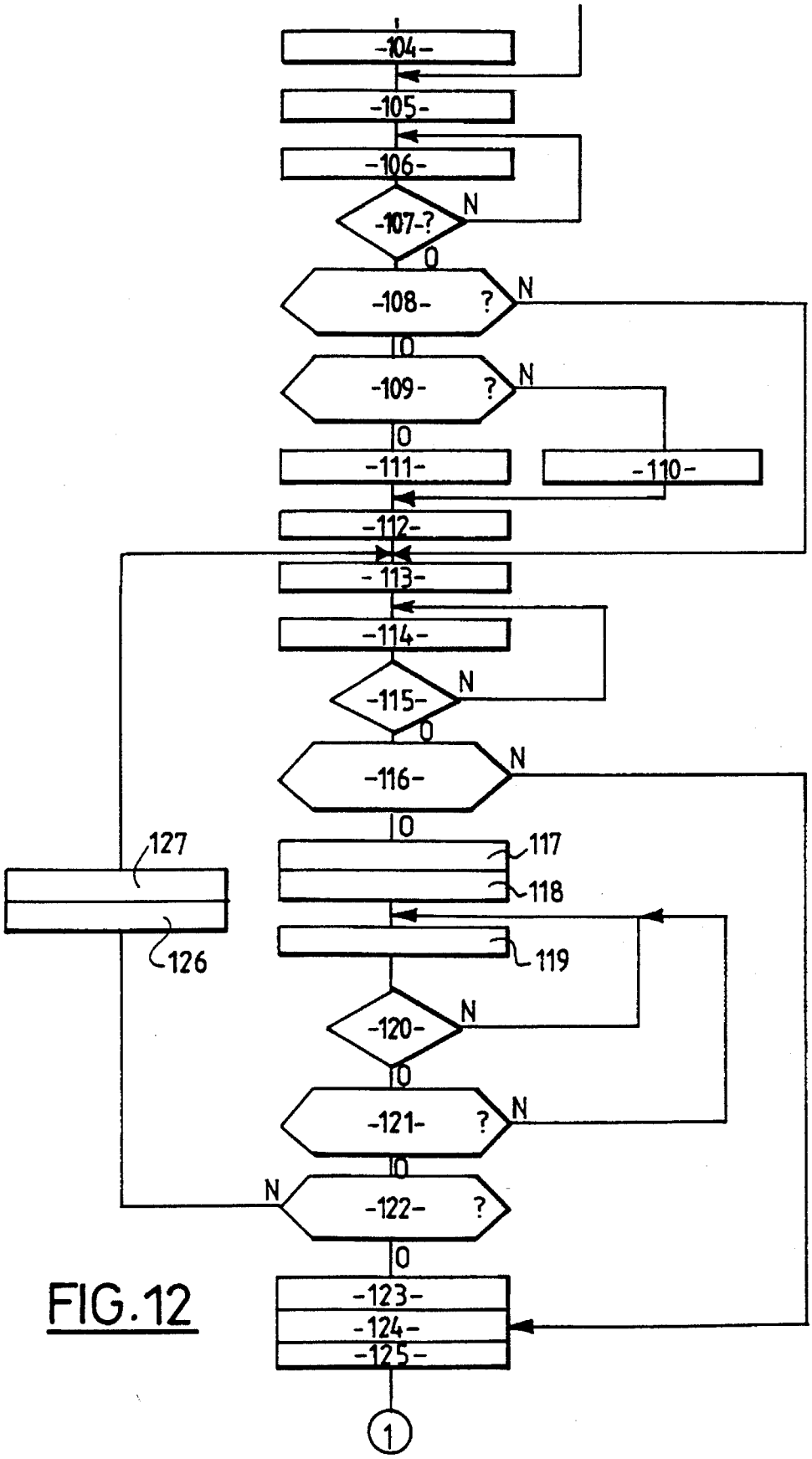

If not, phase 64 is proceeded to, during which it is decided whether the validation button 7 should now be pressed. If so, the setting subprogram described with reference to FIGS. 11 and 12 is proceeded to. If not, phase 65 is proceeded to, for determining whether or not a key number is input. If so, the locking/unlocking subprogram represented in FIG. 10 is proceeded to. If not, phase 66 is proceeded to, during which it is decided whether the input validation button 7 has been actuated. If so, the programmed alarm time with a delay of one second is displayed during phase 67, then during phase 68 there is an interrogation as to whether the input validation button 7 has been actuated. If so, the alarm is enabled during phase 69. If not, it is decided during phase 70 whether the delay has elapsed. If so, phase 61 is returned to. If not, phase 68 is returned to.

The locking/unlocking subprogram represented in FIG. 10 starts with phase 71 indicating the settings of the keyboard and the acceptance of the entry code during phase 65 described with reference to FIG. 9.

During phase 72, the question is asked whether the entry code is correct. If so, it is decided during phase 73 whether the briefcase is open. If not, the first attempt is registered during phase 74 and then during phase 75 it is decided whether the number of attempts is equal to three. If this is the case, the process is interrupted for 30 seconds during phase 76, during which period of time any attempt is made futile.

If the number of attempts determined during phase 75 is less than 3, the system allows the input of a new code to be restarted.

Following the aforementioned phase 73, in the case of the lock being open, this lock is closed during phase 77, that is to say that the microprocessor 22 applies, to the motor 17 for driving the latch 12, a signal whose effect is to place this latch on the path of the rods 13 carrying the closure bolts.

If during phase 73 it is decided that the lock is closed, this lock is opened during phase 78.

Following phases 76, 77 and 78, the main loop described with reference to FIG. 9, and more particularly phase 61, is returned to.

The description of the part of the flow chart relating to the setting of the device represented in FIGS. 11 and 12 will now be given.

During phase 80, the settings are displayed. Then the acceptance of the code is progressed to in phase 81. Phase 82 is then progressed to, during which it is determined whether a code being entered is equal to the time displayed at that moment.

If it is, phase 83 for displaying the scrambled code is progressed to.

If not, phase 84 for determining whether the code entered is correct is progressed to. If so, phase 85 for displaying the word "time" is progressed to, and if not, phase 86 for accounting the number of attempts for blocking entry is passed to.

During phase 87, it is determined whether the number of attempts is equal to three. If so, phase 88 for waiting 30 seconds and resetting the count is passed to. If not, an attempt can be restarted.

For this purpose, phase 61 of the flow chart in FIG. 9 is returned to.

Following phase 83, phase 89 for interrogation relating to the holding of the validation key 7 is progressed to. If so phase 83 for continuing to display the scrambled code is returned to. If not, phase 61 of the flow chart in FIG. 9 is returned to.

Returning now to the display of the word "time" during phase 85, this phase is followed by an acceptance phase 90 followed in turn by a phase 91 of interrogation relating to the actuation or not of the validation key 7. If not, phase 90 is returned to.

If it is, a phase 92 for interrogation relating to the setting of the time is progressed to. If a new time has been entered, phase 93 for setting the time is progressed to. If not, phase 94 for displaying the word "alarm" or "wake-up" is progressed to directly, and then the phase 95 for acceptance of the alarm time.

During the subsequent phase 96, it is determined whether the validation key 7 has been actuated. If not, phase 95 is returned to. If so, phase 97 for determining whether a new time has been entered is progressed to. If so, phase 98 for setting the alarm time is progressed to, and if not, phase 99 for displaying the word "DATE" is jumped to directly.

Phase 100 for acceptance of the date is then progressed to.

During phase 101, it is determined whether or not the validation key has been actuated; if not, phase 100 is returned to.

If it has been, phase 102 for determining whether a new date has been entered is progressed. If so, phase 103 for determining whether the date is an existing date is progressed to. If not, phase 100 is returned to.

If it is, phase 104 for setting the date, which appears at the top of the flow chart in FIG. 12, is progressed to.

If during phase 102 it is noticed that the date has not been altered, phase 105 for displaying the word "NAME" is progressed to directly.

Phase 106 for name acceptance and phase 107 for determining whether the validation key has been actuated are then progressed to. If not, phase 106 is returned to. If it has been, phase 108 for determining whether another name has been entered is progressed to. If not, the operation for displaying the word "CODE" is passed to directly. If one has, phase 109 for determining whether the name has been written is progressed to. If not, during phase 110, the display program is set for continuously displaying the time; if it has, phase 111 for programming the alternative display of the name and the time is progressed to.

After phase 110 or phase 111, phase 112 for writing a name is progressed to.

Phase 113 for displaying the word "CODE" is then progressed to. Following this, phase 114 for acceptance of the code, and phase 115 for determining whether or not the validation key 7 has been actuated. If not, phase 114 is returned to. If it has, phase 116 for determining whether a new code is entered is progressed to.

If so, the first code setting 117 is progressed to, followed by the phase 118 of displaying the word "CONF" indicating confirmation. The phase 119 for acceptance of the code and phase 120 for determining whether or not the validation key 7 has been actuated are progressed to.

If not, phase 119 is returned to.

If it has, a new phase 121 for determining whether a code has been entered is progressed to. If not, phase 119 is returned to. If it has been, phase 122 for determining whether the code indicated corresponds to the code first entered is progressed to. If so, phase 123 for establishing the code and phase 124 for displaying the word "OK" indicating that the code entered is accepted is progressed to. A phase 125 for waiting one second before finally returning to the start, i.e. phase 61, of the main loop of the flow chart is progressed to.

If during phase 116 it is decided that a new code has not been entered, phase 124 for displaying the word "OK" indicating that the programming is finished is progressed to directly.

If during phase 122 it is decided that the code entered the second time is not correct, an error display phase 126 then a phase 127 for waiting one second are progressed to, then phase 113 for displaying the word "code" is returned to in order to restart the code input operation.

The flow chart described with reference to FIGS. 9 to 12 is executed by actuating the numerical keys 5 and the validation key 7 of the keyboard in order to input the working data of the device into memory.

The key 7 is used to allow the code chosen by the user to be entered into the storage program.

For this purpose, an initial access code, for example chosen equal to 0, is generated by simultaneously actuating the key 0 and the validation key 7, which causes the word "TIE" corresponding to the time to appear on the display device.

The user can then enter the current time by actuating the numerical keys 5, and by causing the time to appear on the display screen 3.

Subsequent actuation of the key 7 causes the display of the word "DATE" on the screen, which initiates the operation of displaying the date on the screen 3.

Subsequent pressing of the key 7 causes the word "ALARM" to appear allowing setting of the time at which the alarm function can be actuated.

The alarm time is reselected using the numerical keys 5.

The key 7 is then again actuated in order to cause the word "NAME" to appear, which indicates that the procedure for storing the name of the owner of the briefcase can be executed.

This procedure is again carried out using the numerical keys in the following manner.

The keys indicating the digits 1, 3, 5, 7 make it possible respectively to display the letters A to Z in this order in the four regions of the display screen.

The keys indicating the digits 2, 4, 6, 8 make it possible to display the letters A to Z in the reverse order.

The numerical keys 5 of the keyboard therefore have an additional function which consists in controlling the appearance of the letters of the alphabet on the liquid-crystal display device during the part of the program for storing the name of the owner of the briefcase in memory.

The validation key 7 also initializes the program for selecting and storing the access code.

For this purpose, this button is pressed, which causes the appearance of the word "CODE" on the display device.

The four digits of the access code which it is desired to adopt are then chosen using the numerical keys 5.

Subsequent actuation of the key 7 causes the word "CONF" to appear, indicating to the user that he has to retype the access code.

After subsequent validation using the key 7, the word "OK" appears on the screen 3, indicating that the code is finally recorded.

The locking device which has just been described includes in addition a function of recovering a forgotten access code.

When the owner of the briefcase has forgotten his access code, he goes to the retailer who sold him the briefcase.

In order to recover the forgotten code, it is first necessary to type a random code, for example the four digits corresponding to the current time, using the numerical keys 5, while keeping the validation key 7 pressed for a specified length of time.

An alphanumeric code with four elements corresponding to the scrambled access code then appears on the screen 3.

The retailer, who has a deciphering grid, then recovers the access code of the user by comparing the elements of the alphanumeric code displayed with the elements of the grid.

In the embodiment which has just been described, the keyboard for typing the access code and for inputting the working data is incorporated with the locking device mounted on the luggage.

It is also possible to produce such a device with a keyboard forming part of a remote-control box, or alternatively, as described with reference to FIG. 8, to combine a separate remote-control box with a keyboard incorporated with the device and operating in parallel with this keyboard.

We claim:

1. A device for locking a closure mechanism for luggage, the luggage having a first part, a second part, a strike defined by an opening in the second part, and a clasp bolt movably mounted in the first part and interengageable with the strike, the device comprising:

at least one driving rod, axially moveable along a longitudinal path, for driving the clasp bolt;

a latch interposable on the path of the driving rod; and a mechanism for moving the latch between an active position of blocking the movements of the drive rod and a retracted position of releasing the drive rod, the mechanism comprising:

an electric motor;

a gear reduction unit for amplifying the output torque of the electric motor and for blocking the latch in position when the electric motor is not activated;

means for connecting the gear reduction unit to the latch, comprising:

an output gear on the gear reduction unit;

an actuation arm coupled to the output gear; and means, comprising an elastic member, for coupling the actuation arm with the output gear, wherein the latch and the actuation arm are angularly displaceable, with elastic return, relative to the output gear; and means for generating electrical control signals for the electric motor in response to the reception of an access code.

2. A locking device according to claim 1, characterized in that the means for generating the electrical control signals for the electric motor comprises:

a microprocessor having a memory;

programs, stored in the memory of the microprocessor, of several functions of the device;

working data stored in the memory of the microprocessor and input by the user;

a keyboard for typing the access code and for typing an input of the working data, the keyboard comprising numerical keys and a validation key; and a device for displaying the working data input via the keyboard.

3. A locking device according to claim 2, characterized in that the working data comprise the access code and in that the numerical keys and the validation key allow the user to input an access code of his choice into the memory.

4. locking device according to either claim 2 or claim 3, characterized in that the working data which can be input using the numerical keys and the validation key also comprise at least one member selected from the group consisting of the time, an alarm time, the date, and a letter text.

5. A locking device according to claim 3, characterized in that the validation key is the key both for entering working data into a storage subprogram and for re-inputting the access code.

6. A locking device according to one of claims 1, 2, 3, or 5, further comprising a means for retrieving an access code forgotten by the user, by ordering the display of a code corresponding to a scrambled access code and deciphering the scrambled code by comparing it with the elements of a correspondence grid.

7. A locking device according to claim 1, characterized in that the means for coupling the actuation arm with the output gear comprises:

a hub of the output gear;

an extension of the hub of the output gear;

a hub of the actuation arm;

a shoulder extending over a portion of a periphery of the hub of the actuation arm and against which the extension of the hub of the output gear bears;

an axial annular groove defined by the output gear and actuation arm; and a torsion spring arranged in the annular groove and attached to the output gear and to the actuation arm and allowing relative angular displacement between the output gear and the actuation arm when the latter is rotationally immobilized by the latch coming into the active position of blocking.

8. A locking device according to either claim 1 or claim 7, wherein the latch comprises a branch displaceable on the path of the driving rod and a side branch operatively engageable with the actuation arm; and further comprising a stop for immobilizing the latch when in the active position of blocking.

9. A locking device according to one of claims 2, 3, 5, or 7, characterized in that the keyboard forms part of a remote-control box associated with the device.

10. A locking device according to one of claims 2, 3 or 5, characterized in that the device is actuated by a remote-control box in parallel with the keyboard.

11. A locking device according to one of claims 2, 3, or 5, characterized in that the device further comprises batteries having a voltage, and the microprocessor has been programmed to monitor the voltage of the batteries continually and to send a signal when the voltage of the batteries passes below a predetermined level.

* * * * *